US012594483B2

(12) United States Patent
Aoki

(10) Patent No.: US 12,594,483 B2
(45) Date of Patent: Apr. 7, 2026

(54) BASEBALL GLOVE

(71) Applicant: TRION CORPORATION, Osaka (JP)

(72) Inventor: Kan Aoki, Osaka (JP)

(73) Assignee: Trion Corporation, Osaka (JP)

( * ) Notice: Subject to any disclaimer, the term of this patent is extended or adjusted under 35 U.S.C. 154(b) by 0 days.

(21) Appl. No.: 18/952,161

(22) Filed: Nov. 19, 2024

(65) Prior Publication Data

US 2026/0034427 A1 Feb. 5, 2026

(30) Foreign Application Priority Data

Aug. 2, 2024 (JP) ..... 2024-127883

(51) Int. Cl.
*A63B 71/14* (2006.01)
*A63B 102/18* (2015.01)

(52) U.S. Cl.
CPC ..... *A63B 71/143* (2013.01); *A63B 2102/18* (2015.10)

(58) Field of Classification Search
CPC ..... A63B 71/143; A63B 2102/18
See application file for complete search history.

(56) References Cited

U.S. PATENT DOCUMENTS 1,000,567 A * 8/1911 Whitley ..... A63B 71/143 2/19
2,475,262 A * 7/1949 Sonnett ..... A63B 71/143 D29/115
3,528,107 A * 9/1970 Rosenbaum ..... A63B 71/143 2/19
5,329,639 A * 7/1994 Aoki ..... A63B 71/143 2/161.1
2014/0259257 A1* 9/2014 Hewitt ..... A63B 71/143 2/19

FOREIGN PATENT DOCUMENTS

JP 2009291239 A * 12/2009
JP 2023-000128 A 1/2023

* cited by examiner

*Primary Examiner* — Tajash D Patel
(74) *Attorney, Agent, or Firm* — Knobbe, Martens, Olson & Bear, LLP

(57) ABSTRACT

A baseball glove that offers improvements in fit and linkage with motion of fingers. The baseball glove includes an outside glove unit and an inside glove unit that are combined together. The inside glove unit includes one piece of a back-side part and a plurality of palm-side parts joined together to the back-side part. The plurality of the palm-side parts include at least a thumb part, an index finger part, a middle finger part, a third finger part, and a little finger part. With each of the finger parts being joined to the back-side part, a finger stall in which each of fingers is inserted is formed so as to have a flat shape on a back side and a curved shape suitable for a finger shape on a palm side.

11 Claims, 20 Drawing Sheets

BASEBALL GLOVE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD

The present disclosure relates to a baseball glove including an outside glove unit and an inside glove unit that are combined together.

BACKGROUND

The glove has a general configuration as disclosed in Patent Document 1 below, for example. In FIG. 1, a basic configuration is shown. A glove G includes an outside glove unit OG and an inside glove unit IG that are joined together such that the inside glove unit IG is built inside the outside glove unit OG. The outside glove unit OG has a ball catching surface to directly catch a ball, whereas the inside glove unit IG has an area that a player's fingers directly touch.

As shown in FIG. 1, the inside glove unit IG includes one piece of a palm-side part 100 and a back-side part 200 made up of five parts. Specifically, a thumb part, an index finger part, a middle finger part, a third finger part, and a little finger part are each joined to the palm-side part 100 by sewing. In other words, the five finger parts exist on a back side, and one piece of the palm-side part exists on a palm side. With the finger parts being joined to the palm-side part, finger stalls provided for the respective fingers are formed. As shown in FIG. 5A, this finger stall has a cross-sectional shape that is curved toward the back side and that is flat on the palm side.

PATENT DOCUMENT FOR CONSIDERATION

Patent Document 1: JP-A-2023-000128

SUMMARY

Unfortunately, when it comes to glove control for ball catching, a fit and a linkage between the conventional glove and motion of the fingers of the player for ball catching are not satisfactory, and thus there is room for improvement in a structure of the conventional glove. The inventor of the present disclosure has found that such disadvantages in usability are ascribable to the cross-sectional shape that is flat on a ball catching surface side, as shown in FIG. 5A.

In view of the above background, a challenge for the present disclosure is to provide a baseball glove that offers improvements in fit and linkage with motion of fingers.

A baseball glove according to the present disclosure, accomplished to solve the challenge above, includes an outside glove unit and an inside glove unit that are combined together. The inside glove unit includes one piece of a back-side part and a plurality of palm-side parts joined together to the back-side part. The plurality of the palm-side parts include at least an index finger part, a middle finger part, and a third finger part, and with each of the finger parts being joined to the back-side part, a finger stall in which each of fingers is inserted is formed so as to have a flat shape on a back side and a curved shape suitable for a finger shape on a palm side.

Action and effect of the baseball glove according to such a configuration will be described. The glove includes an outside glove unit and an inside glove unit that are combined together, and is similar to the conventional glove in this respect. On the other hand, the inside glove unit includes one piece of a back-side part and a plurality of palm-side parts joined together to the back-side part. In other words, one piece of a palm-side part and a plurality of back-side parts are joined together in the conventional glove, and thus the relationship between the palm-side and back-side parts in the glove of the present disclosure is the inverse of that in the conventional glove. Due to such an inverse relationship in the glove of the present disclosure, a cross-sectional shape of the finger stall is formed so as to have a flat shape on the back side and a curved shape suitable for a finger shape on the palm side. Since the finger stall has a curved shape on a ball catching surface side, the glove offers an increased degree of fit with the fingers and improved usability. This makes it possible to provide a baseball glove that offers improvements in fit and linkage with motion of fingers.

In the present disclosure, it is preferable that the palm-side parts further include a thumb part and a little finger part.

In the present disclosure, it is preferable that the palm-side parts further include a sixth part that is joined to each of the finger parts in a root area of each of the finger parts.

It is preferable that the back-side part according to the present disclosure includes finger sections corresponding to the finger parts that constitute the palm-side parts, widths of the finger parts are set so as to be wider than respective widths of the corresponding finger sections, and the curved shape is formed when each of the finger sections of the back-side part is joined to each of the finger parts of the palm-side parts.

In the present disclosure, it is preferable that the baseball glove is designed to suit a small-sized palm through an adjustment intended to make root-side lengths of the index finger part, the middle finger part, and the third finger part longer and an adjustment intended to make a vertical width of the sixth part narrower with a vertical length and a lateral length of the inside glove unit remaining unchanged.

In the present disclosure, it is preferable that the baseball glove is designed to form a shape of a finger stall that suits a finger size through an adjustment made to a width and a shape of each of the finger parts with a vertical length and a lateral length of the inside glove unit remaining unchanged.

In the present disclosure, it is preferable that the baseball glove is designed to change a finger insertion site through an adjustment made to an angle of inclination of any of an inclined line of a place for joining the little finger part to the third finger part, an inclined line of a place for joining the third finger part to the middle finger part, and an inclined line of a place for joining the middle finger part to the index finger part with a vertical length and a lateral length of the inside glove unit remaining unchanged.

In the present disclosure, it is preferable that protrusions are formed at distal ends of the index finger part, the middle finger part, and the third finger part to protrude beyond respective distal ends of an index finger section, a middle finger section, and a third finger section of the back-side part when the finger sections of the back-side part are joined to the corresponding finger parts of the palm-side parts, and a cushioning material is joined to the protrusions.

In the present disclosure, it is preferable that the finger parts adjacent to each other are joined together by folding ends of the finger parts at a place for joining to a ball catching surface side and sewing the folded ends together.

In the present disclosure, it is preferable that the sixth part and each of the finger parts are joined together by folding an end of the sixth part and an end of each of the finger parts at a place for joining to a ball catching surface side and sewing the folded ends together.

In the present disclosure, it is preferable that a portion of the middle finger part and a portion of the third finger part at a place for joining form an external shape such that the portions of the finger parts become increasingly separated from each other with an advance toward a finger root side, and a portion of the middle finger part and a portion of the index finger part at a place for joining form an external shape such that the portions of the finger parts become increasingly separated from each other with an advance toward the finger root side.

DETAILED DESCRIPTION

Figure 2:
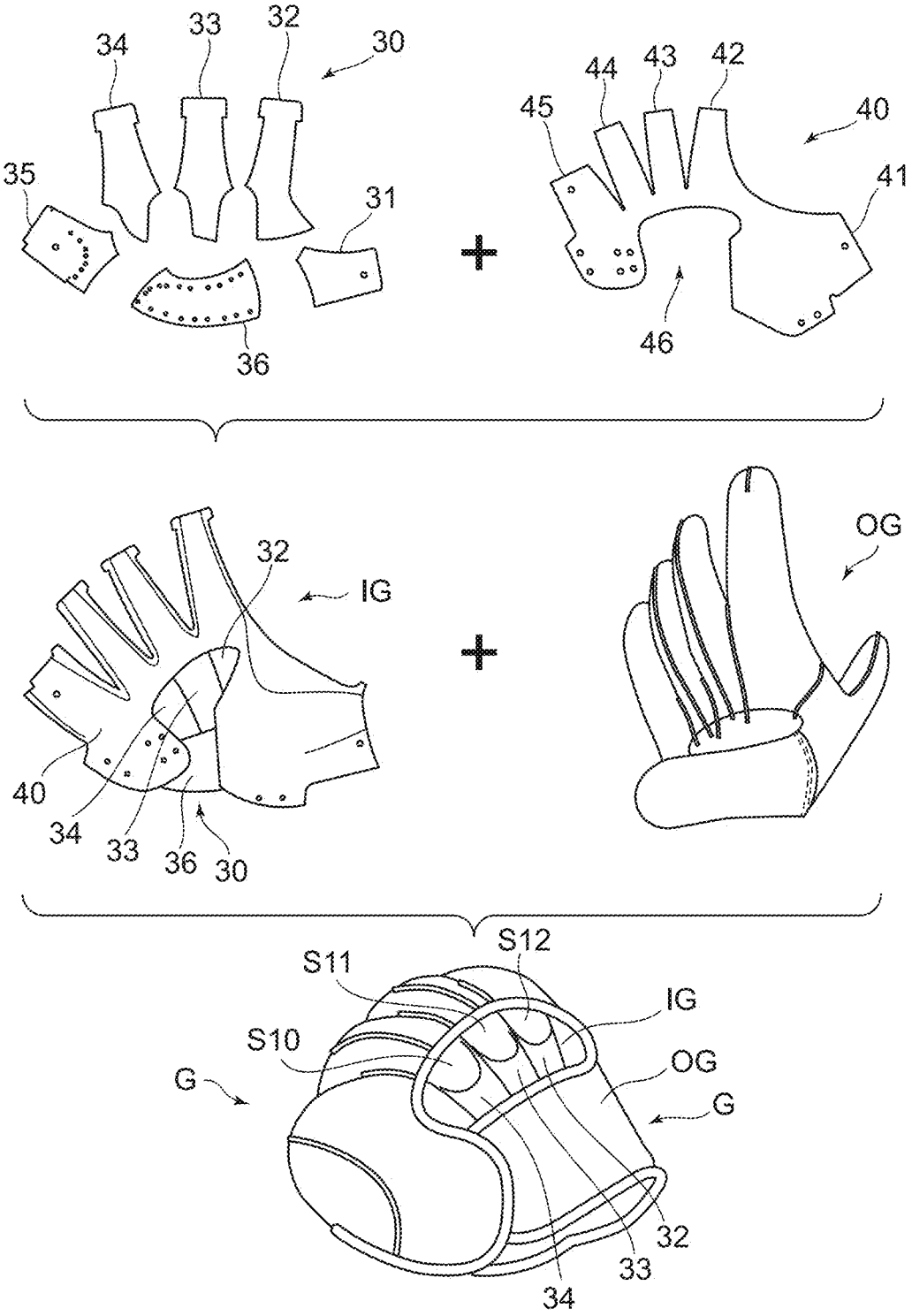
FIG. 2 is an exploded view showing a basic configuration of a glove according to the present disclosure.

Preferred embodiments of a baseball glove according to the present disclosure will be described with reference to the drawings. FIG. 2 is an exploded view showing a basic configuration of a glove according to the present disclosure.

In the present specification, a finger part refers to at least one of a thumb part, an index finger part, a middle finger part, a third finger part, and a little finger part. A finger section refers to at least one of a thumb section, an index finger section, a middle finger section, a third finger section, and a little finger section.

When each member of the baseball glove is described, a palm side refers to a side having a ball catching surface, and a back side refers to a side opposite the palm side.

An inside glove unit IG includes one piece of a back-side part 40 and a plurality of palm-side parts 30 joined together to the back-side part 40. For a material for each part, either of a known leather material and artificial leather may be selected. The plurality of the palm-side parts 30 are a total of six parts including a thumb part 31, an index finger part 32, a middle finger part 33, a third finger part 34, a little finger part 35, and a heel pad cover 36 (equivalent to a sixth part). In other words, the palm-side parts include the five finger parts and one piece of the heel pad cover 36. The back-side part 40 and the six palm-side parts 30 are joined together to make up the inside glove unit IG. A glove G is completed by joining the inside glove unit IG to an outside glove unit OG. FIG. 2 shows only members related to the present disclosure, omitting other members such as straps and cushioning materials.

Figure 3A:
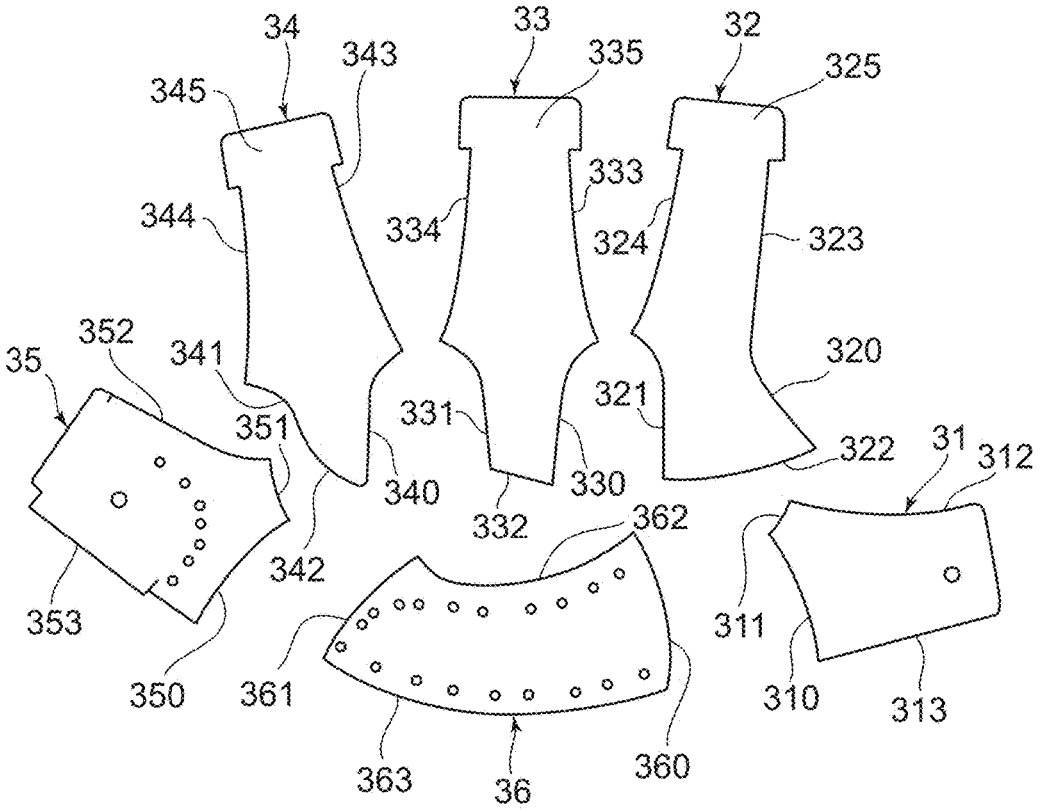
FIG. 3A is a plan view showing a configuration of a plurality of palm-side parts, viewed from a back side.
Figure 3B:
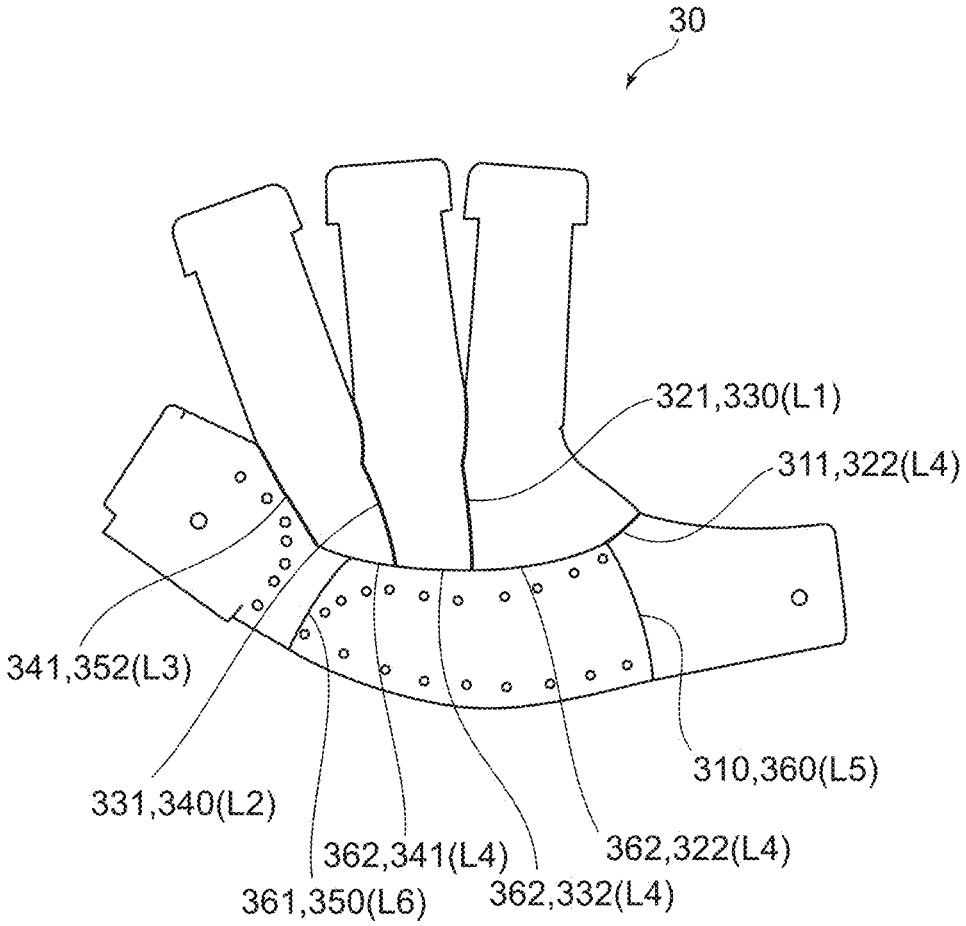
FIG. 3B is a plan view showing a state of the plurality of the palm-side parts joined together, viewed from the back side.
Figure 3C:
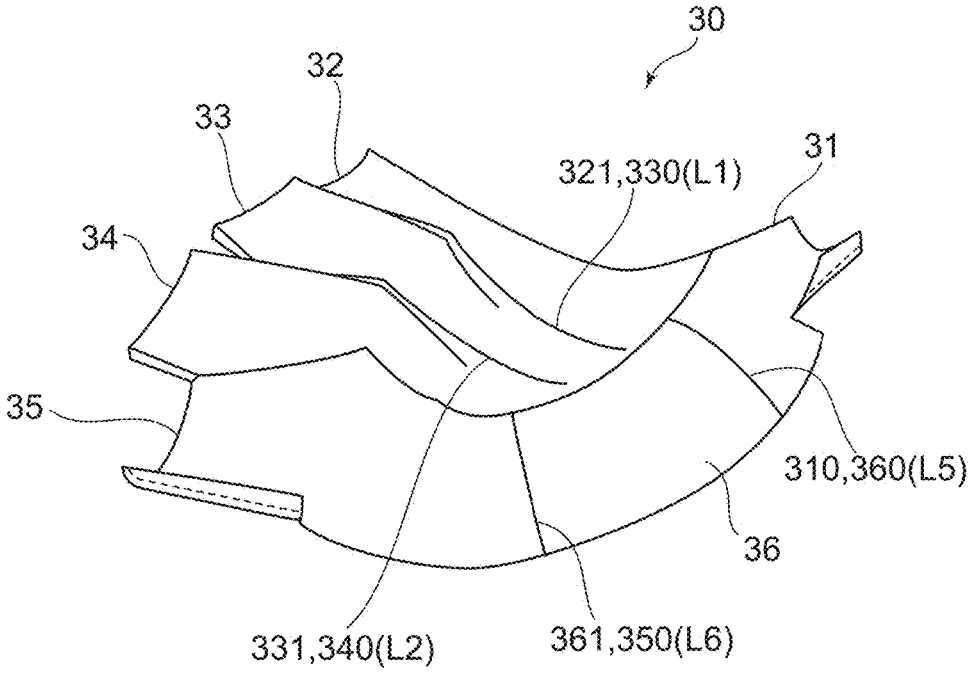
FIG. 3C is a perspective view showing a state of the plurality of the palm-side parts joined together, viewed from a palm side.

FIG. 3A is a plan view showing a configuration of the plurality of the palm-side parts 30, viewed from the back side. FIG. 3B is a plan view of a state of the plurality of the palm-side parts 30 joined together, viewed from the back side. FIG. 3C is a perspective view of a state of the plurality of the palm-side parts 30 joined together, viewed from the palm side.

The thumb part 31 has a first joining line 310 and a second joining line 311. The index finger part 32 has a first joining line 321 and a second joining line 322. The middle finger part 33 has a first joining line 330, a second joining line 331, and a third joining line 332. The third finger part 34 has a first joining line 340 and a second joining line 341. The little finger part 35 has a first joining line 350, a second joining line 351, and a third joining line 352. The heel pad cover 36 has a first joining line 360, a second joining line 361, and a third joining line 362. Each joining line of a part is a place joined to another part by sewing.

The thumb part 31 has a first external line 312 and a second external line 313. The index finger part 32 has a first external line 323, a second external line 324, and a distal end 325. The middle finger part 33 has a first external line 333, a second external line 334, and a distal end 335. The third finger part 34 has a first external line 343, a second external line 344, and a distal end 345. The little finger part 35 has an external line 353. The heel pad cover 36 has an external line 363.

The first joining line 321 of the index finger part 32 and the first joining line 330 of the middle finger part 33 form an external shape such that the joining lines become increasingly separated from each other with an advance toward a finger root side. The second joining line 331 of the middle finger part 33 and the first joining line 340 of the third finger part 34 form an external shape such that the joining lines become increasingly separated from each other with an advance toward the finger root side. The shape thus formed enables formation of a three-dimensional finger stall when the finger parts are joined together.

The first external line 323 and the second external line 324 of the index finger part 32 form an external shape such that the external lines become closer to each other with an advance toward a fingertip. The external lines of the other finger parts form the similar external shape.

A large number of holes are formed in a plurality of the palm-side parts 30 and the back-side part 40. This is intended to join the outside glove unit OG to the inside glove unit IG by passing a strap (not shown) through the holes. Since the glove is similar to the conventional glove in this respect, detailed description is omitted.

FIG. 3B is a drawing showing a state of the plurality of the palm-side parts 30 joined together by sewing, viewed from the back side. A first joining line L1 is made up of the joining lines 321, 330. A second joining line L2 is made up of the joining lines 331, 340. A third joining line L3 is made up of the joining lines 341, 352. A fourth joining line L4 is made up of the joining lines 311, 322, 362, 332, 341, 352. A fifth joining line L5 is made up of the joining lines 310, 360. A sixth joining line L6 is made up of the joining lines 350, 361.

The distal ends 325, 335, 345 are parts not sewn onto the back-side part 40, and lengths of finger shapes in the palm-side parts are, by the unsewn parts, longer than lengths of finger shapes formed in the back-side part 40. As shown in FIG. 2, the back-side part 40 has a thumb section 41, an index finger section 42, a middle finger section 43, a third finger section 44, and a little finger section 45 that are formed to correspond to the finger parts of the palm-side parts 30. Each finger part and the corresponding finger section are joined together along the external lines by sewing. A recess 46 (refer to FIG. 2) is formed in an area corresponding to the heel pad cover 36. The index finger part 32, the middle finger part 33, and the third finger part 34 can be checked through an exterior view of the completed glove G, and shapes of finger stalls S10, S11, S12 can also be checked.

Figure 5A:
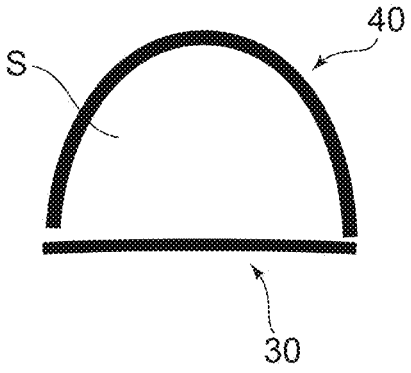
FIG. 5A is a drawing showing a cross-sectional shape of a finger stall of a conventional glove.
Figure 5B:
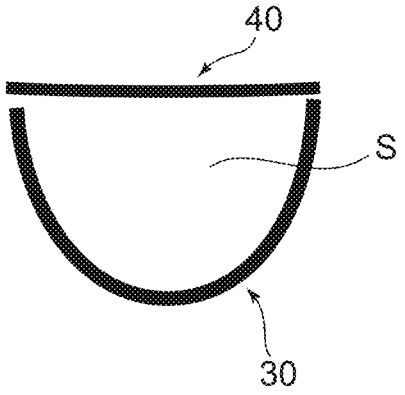
FIG. 5B is a drawing showing a cross-sectional shape of a finger stall of the glove according to the present disclosure.

Widths of the thumb part 31, the index finger part 32, the middle finger part 33, the third finger part 34, and the little finger part 35, which constitute the plurality of the palm-side parts 30, are set so as to be wider than respective widths of the thumb section 41, the index finger section 42, the middle finger section 43, the third finger section 44, and the little finger section 45 of the back-side part 40. This enables formation of a finger stall that has a curved shape as shown in FIG. 5B. A setting of the shape to widen the widths may be determined as appropriate.

The plurality of the joined palm-side parts 30 illustrated in FIG. 3B appear to be flat, but each have a three-dimensional shape in actuality. FIG. 3C is a perspective view of the joined parts, viewed from the back side. Each part has a three-dimensional shape, forming a finger stall in which each finger is inserted.

Figure 3D:
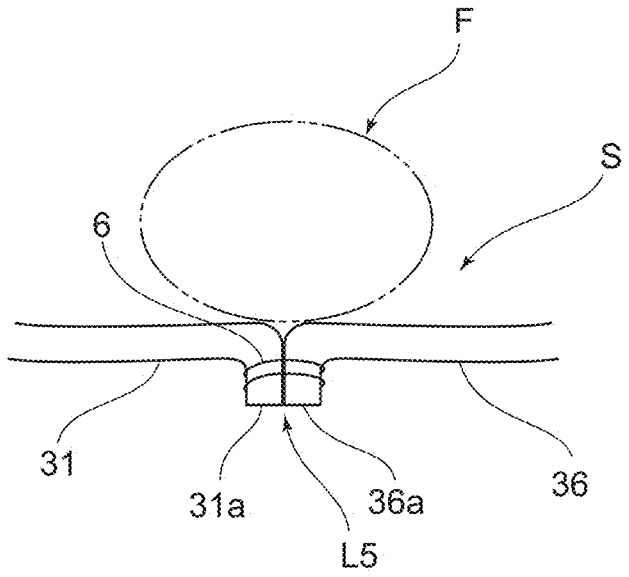
FIG. 3D is a cross-sectional view showing a state of a thumb part and a heel pad cover joined to each other along a joining line.

FIG. 3D is a cross-sectional view showing a state of the thumb part 31 and the heel pad cover 36 joined to each other along the joining line L5. A cross section of a finger is indicated by F. An end 31*a* of the thumb part 31 is folded to a side opposite a finger stall S, and an end 36*a* of the heel pad cover 36 is folded to the side opposite the finger stall. Both ends are joined to each other with thread 6 for sewing. Any protrusion caused by joining is not formed inside the finger stall S, and nothing interferes with an inserted finger. This configuration does not have an undesirable effect on a feel of insertion. Other finger parts may be joined to each other in the same way.

It is conceivable that the thumb part 31, the little finger part 35, and the heel pad cover 36 may be integrated into one part. However, it is preferred that the parts be separated from each other as in the present embodiment to properly form finger stalls for the thumb and the little finger.

FIG. 5B shows a cross-sectional shape of the finger stall S formed according to the present disclosure. The back-side part 40 is shaped like a flat surface, whereas the palm-side part 30 is formed so as to have a curved shape suitable for a finger shape. In other words, a curved shape is formed on a ball catching surface side. The back-side part 40 has a flat surface but may not present a perfectly flat surface and may have a surface that is gently curved to some degree. Such a surface is also included in this concept of flatness. FIG. 5A shows a cross-sectional shape of a finger stall of a conventional glove. A curved shape in the conventional glove is formed on a side opposite the side on which the curved shape according to the present disclosure is formed.

According to the configuration of the present disclosure, the five finger parts form finger stalls that are independent of and separated from each other, and the heel pad cover 36 is connected to the five finger parts. This offers an increased degree of fit with the fingers and improves glove control for ball catching.

Figure 1:
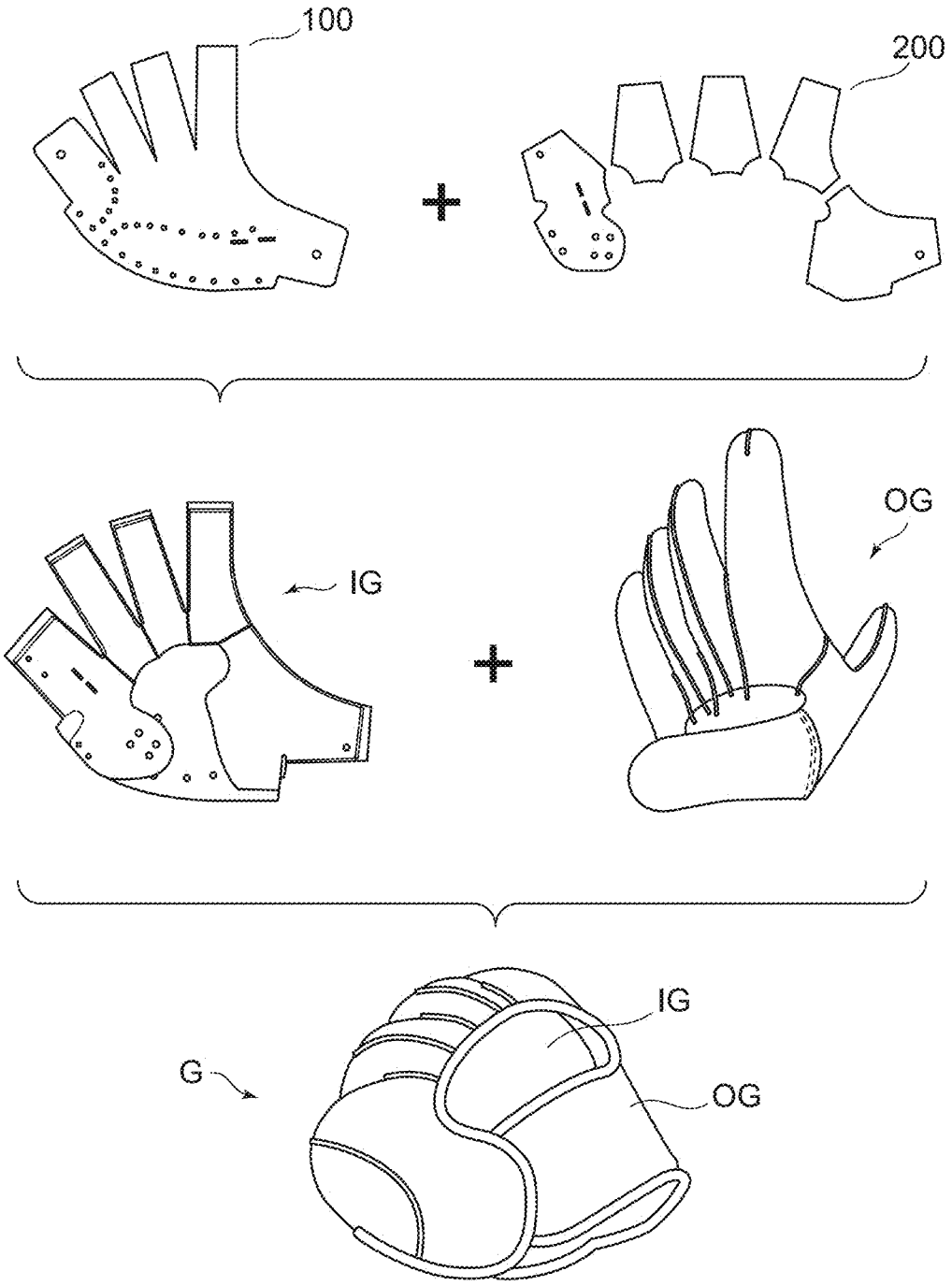
FIG. 1 shows a configuration of a baseball glove according to a conventional technique.

As illustrated with a contrast between FIGS. 1 and 2, a region across which the finger stalls are formed has a length so as to extend to a region for the palm, and the palm region is integrated with the finger stall region. A palm region in the conventional glove is formed by one flat palm-side part. The palm region according to the present disclosure differs from the conventional one, and the finger stalls that are each made three dimensional by the four joining lines L1 to L4 are formed. This provides an improved fit between fingers of a player and the glove, and stabilizes a sense of positional relationship between a crotch region of the inserted fingers and a crotch region of the glove.

Configuration to Suit Hand and Finger Sizes

The palm region in the inside glove unit of the conventional glove is made wide to agree with a palm size in the outside glove unit. The conventional glove is also made such that a site at which the finger is inserted in the finger stall of the inside glove unit matches a position for the finger in the outside glove unit. In other words, the conventional glove is made with priority given to the outside glove unit. A structure of the conventional inside glove unit is created without considering a difference in hand size between the glove and the player. It is hard to say that a sense of unity between the player's hand and the glove is achieved.

Figure 4A:
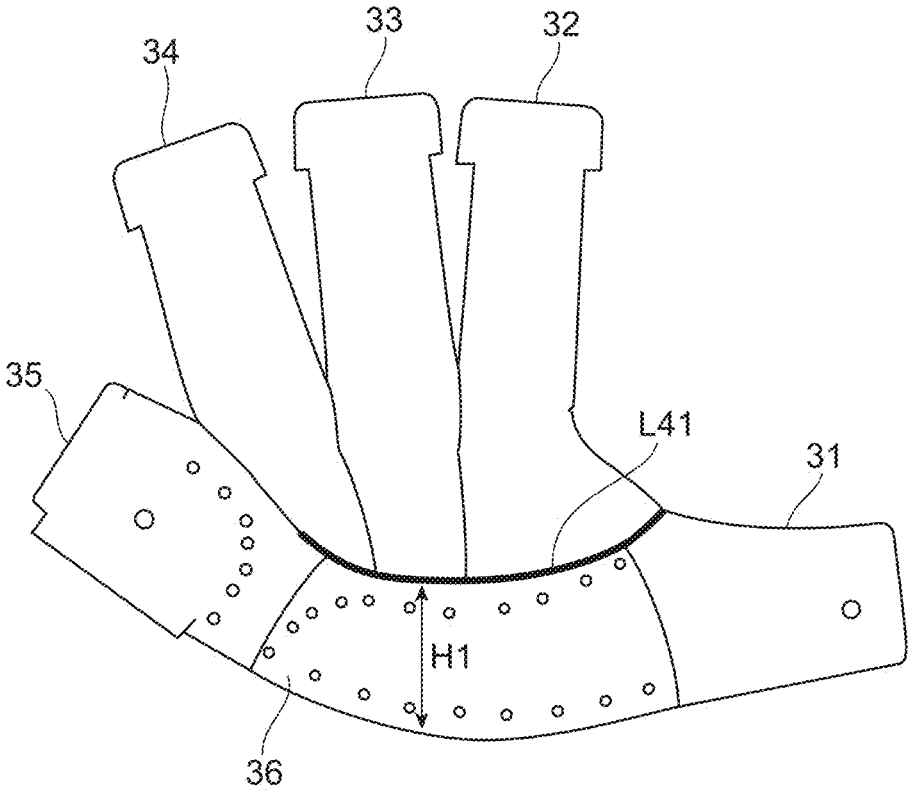
FIG. 4A is a drawing showing a configuration of palm-side parts for a player who has an ordinary palm.
Figure 4B:
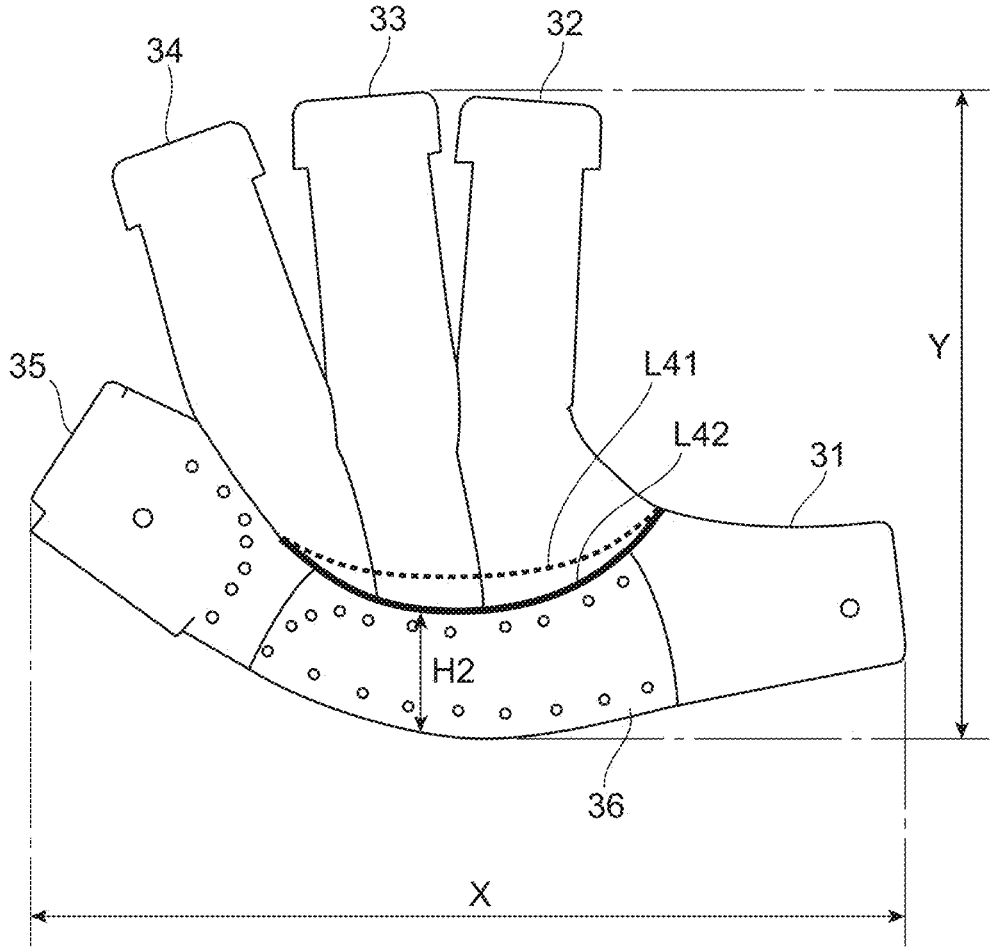
FIG. 4B is a drawing showing a configuration of palm-side parts for a player who has a small palm.

A configuration of the inside glove unit according to the present disclosure makes it possible to make a glove that suits hand and finger sizes. FIG. 4A shows a configuration of palm-side parts for a player who has an ordinary palm, and FIG. 4B shows a configuration of palm-side parts for a player who has a small palm. A difference between both configurations is positions of fourth joining lines L41, L42.

Lower ends of the joining lines L1 to L3 in FIG. 4B are longer. In other words, root-side lengths of the index finger part, the middle finger part, and the third finger part are made longer. When vertical widths H1, H2 of the heel pad covers 36 are compared, the vertical width H2 in FIG. 4B is narrower to adapt to the difference in finger part length. As a result, the joining line L42 is shifted below the joining line L41. This makes it possible to provide a glove that suits a player who has a small palm. This configuration allows the length and width of each part to be adjusted.

In this case, in the states of the plurality of the palm-side parts joined together, no change has been made to an overall size, i.e., a vertical length (Y in FIG. 4B) and a lateral length (X in FIG. 4B). This configuration provides adaptability to a difference in palm size without changing the overall size. This makes it possible to adapt to different palm sizes of individual players without changing any size of the inside glove unit IG or the outside glove unit OG.

Figure 6A:
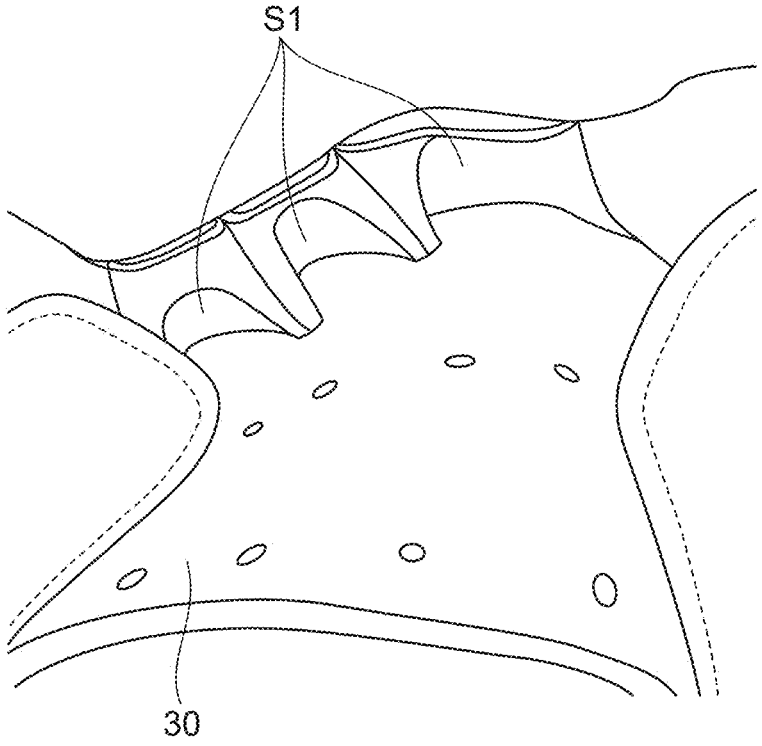
FIG. 6A is a drawing showing a shape of a finger stall in the conventional glove.
Figure 6B:
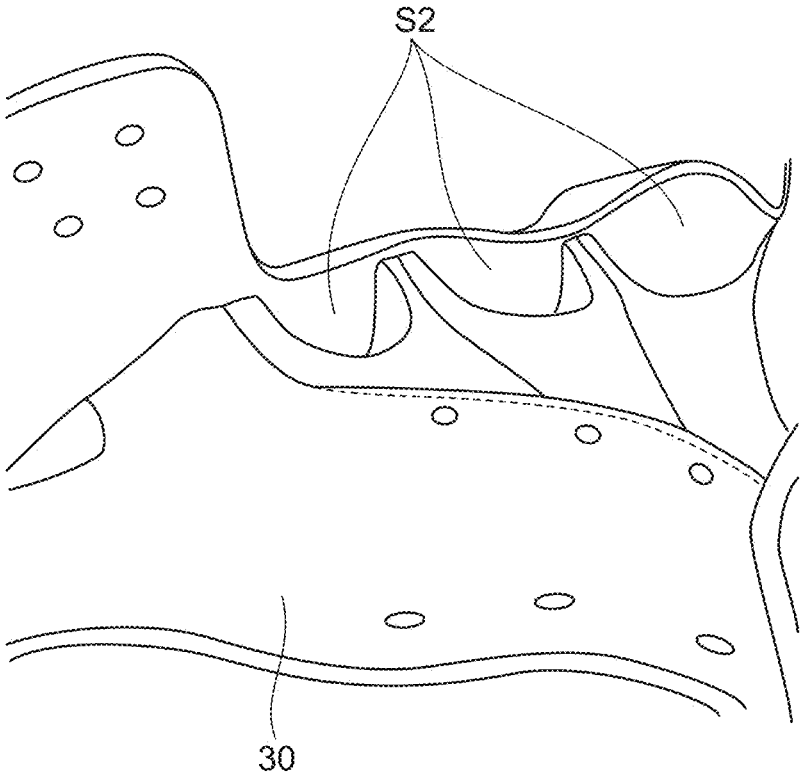
FIG. 6B is a drawing showing a shape of a finger stall in the glove according to the present disclosure.

FIG. 6A is a drawing showing a shape of a finger stall in the conventional glove. As a shape of each finger stall S1, a cross-sectional shape that is curved toward the back side is shown. FIG. 6B is a drawing showing a shape of a finger stall in the glove according to the present disclosure. As a shape of each finger stall S2, a cross-sectional shape that is curved toward the palm side is shown.

Figure 7:
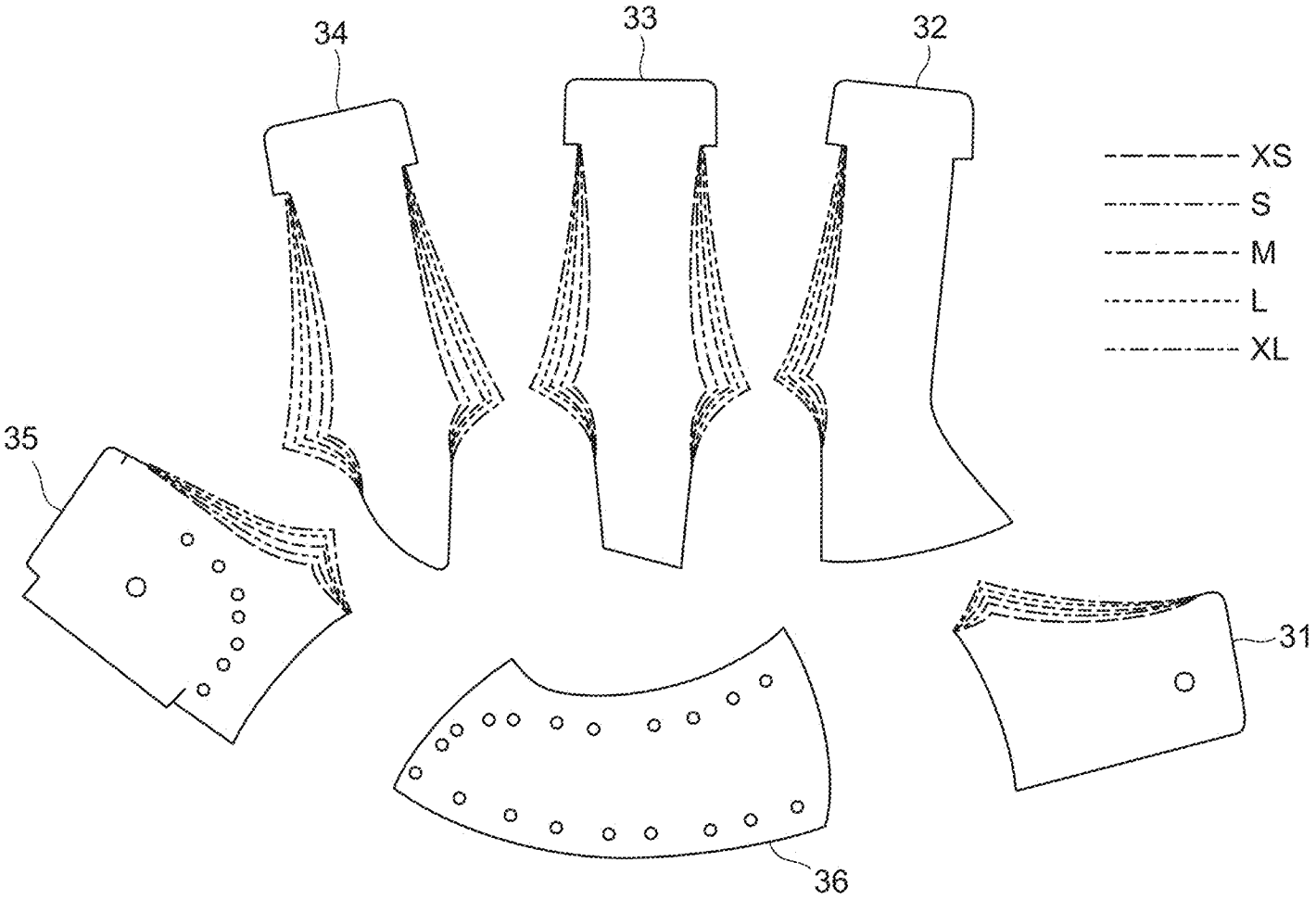
FIG. 7 is a drawing showing adaptability to different finger sizes by changing shapes of the palm-side parts.
Figure 8:
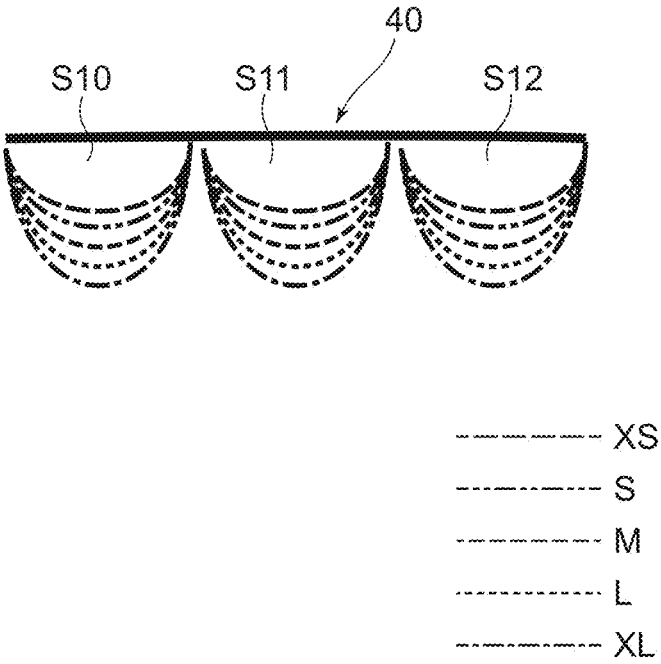
FIG. 8 is a drawing showing varying finger stall sizes for the finger sizes shown in FIG. 7.

FIG. 7 is a drawing showing adaptability to different finger sizes by changing shapes of the palm-side parts. In the drawing, shapes of the palm-side parts that suit XS, S, M, L, and XL sizes, respectively, are shown. For instance, a shape of a finger stall that suits a finger size can be formed by changing (adjusting) the widths of the thumb part 31, the index finger part 32, the middle finger part 33, the third finger part 34, and the little finger part 35. FIG. 8 is a drawing showing varying sizes of the finger stalls S10, S11, S12 for the finger sizes shown in FIG. 7.

In this case, in a similar way to the case of FIG. 4B, in the states of the plurality of the palm-side parts joined together, no change has been made to the overall size, i.e., the vertical length and the lateral length.

A combination of shape changes shown in FIG. 7 and shape changes shown in FIGS. 4A and 4B makes it possible to suit hand and finger sizes of more diverse players. The shape changes above can be made without changing a shape of the outside glove unit OG.

Figure 9A:
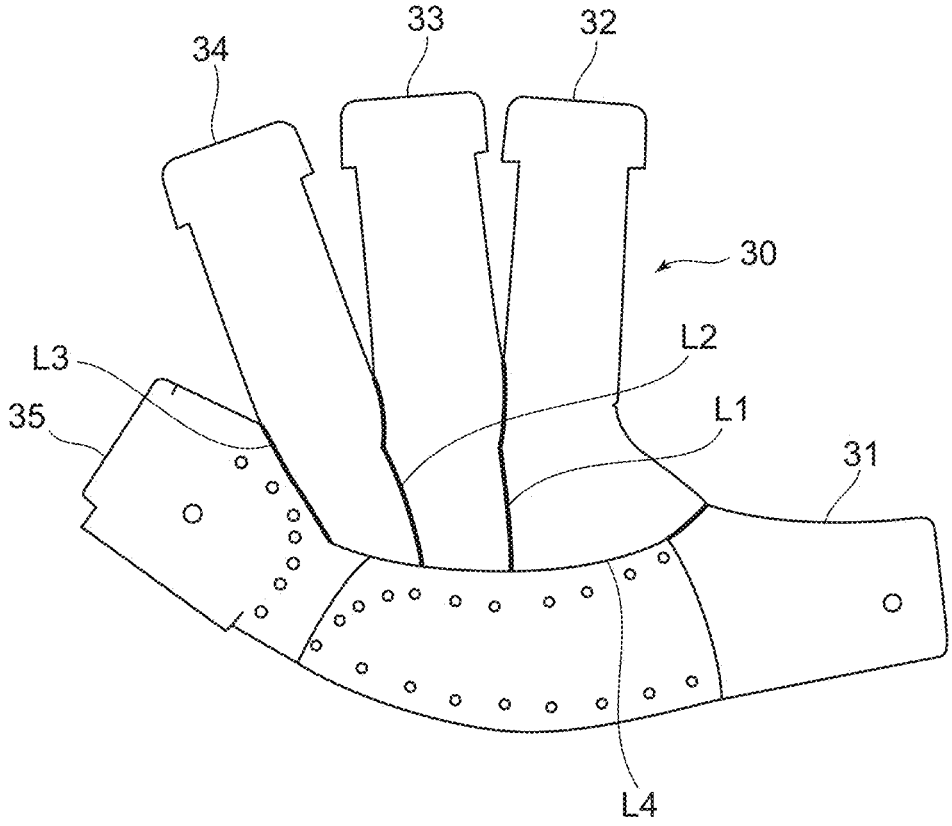
FIG. 9A is a drawing showing palm-side parts of a glove according to a standard specification.
Figure 9B:
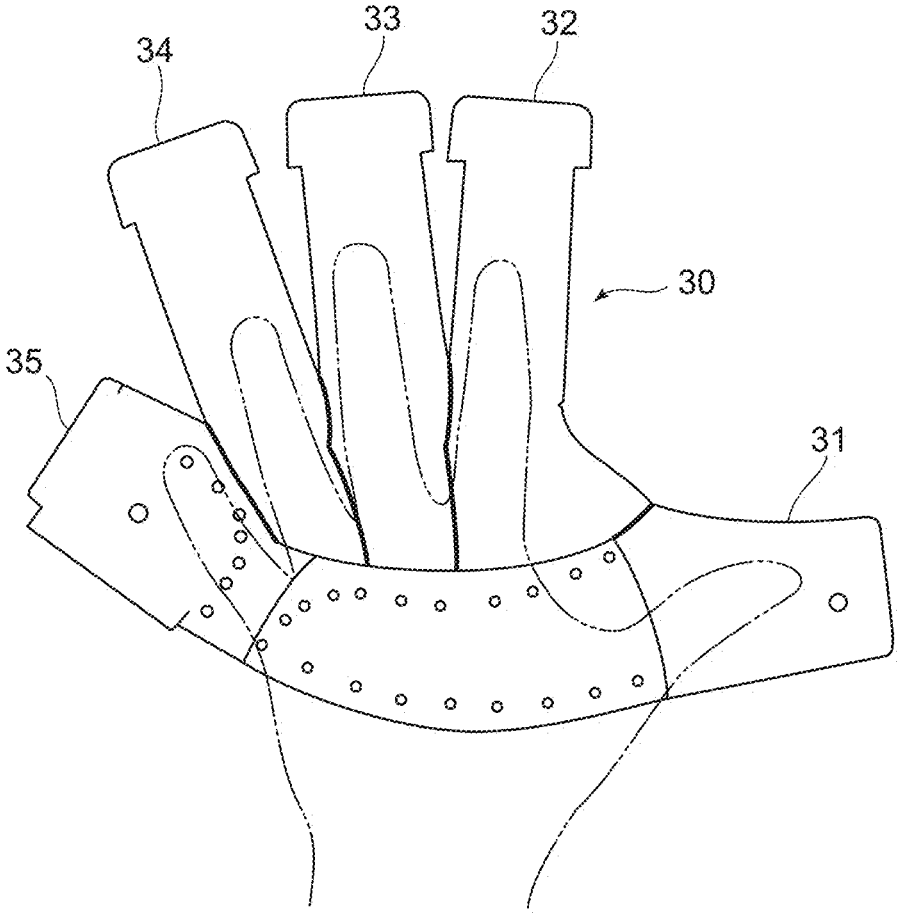
FIG. 9B is a drawing showing a state of the palm-side parts of FIG. 9A in which fingers indicated by a phantom line are inserted.
Figure 10A:
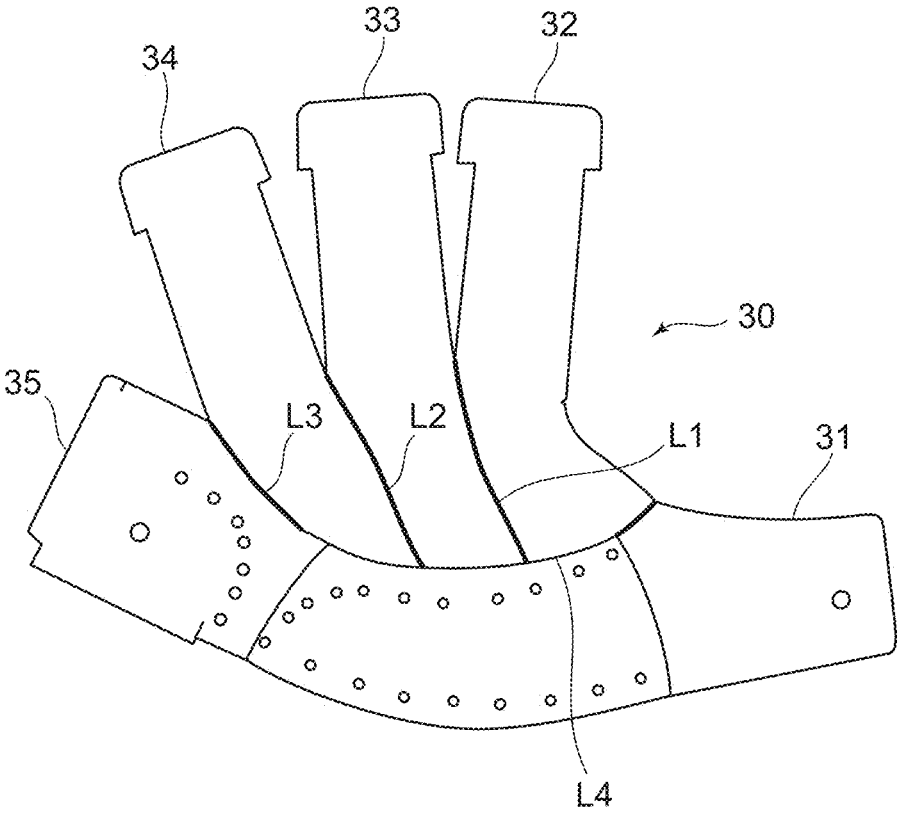
FIG. 10A is a drawing showing palm-side parts of a glove according to a special specification.
Figure 10B:
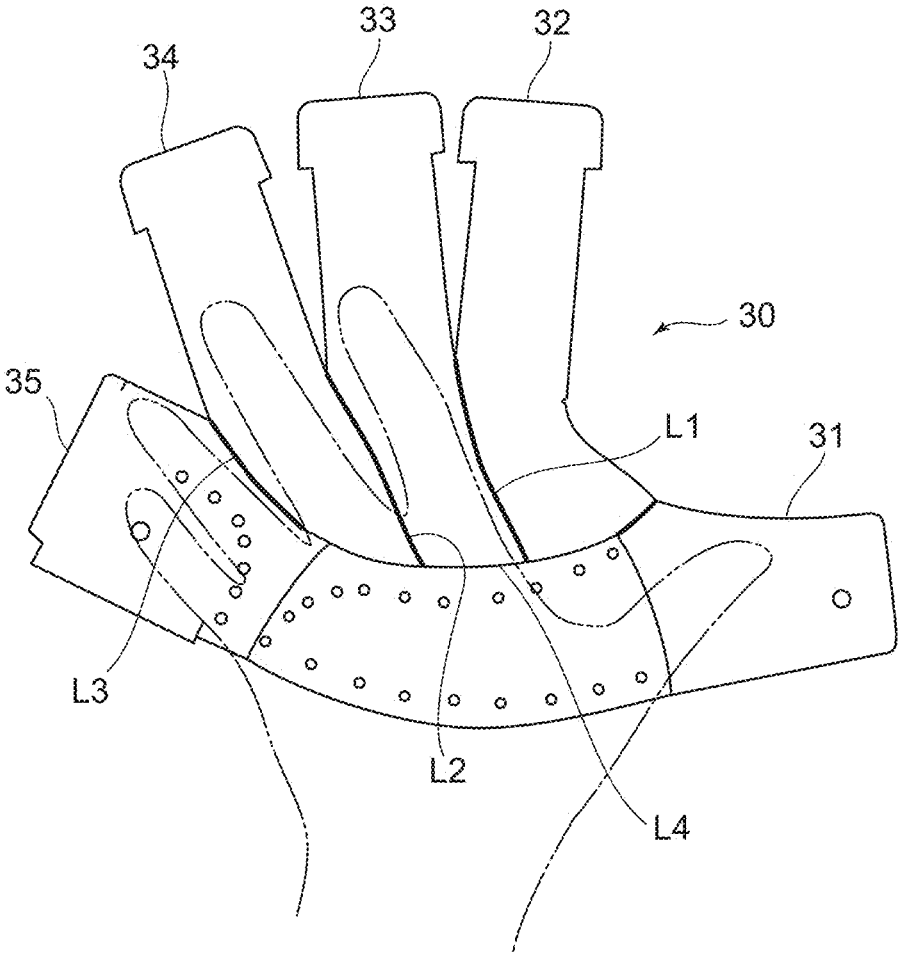
FIG. 10B is a drawing showing a state of the palm-side parts of FIG. 10A in which fingers indicated by a phantom line are inserted.

FIG. 9A shows palm-side parts of a glove according to a standard specification, and FIG. 9B shows a state of the palm-side parts in which fingers indicated by a phantom line are inserted. In most cases, fingers are inserted in all the respective finger stalls. FIG. 10A shows palm-side parts of a glove according to a special specification, and FIG. 10B shows a state of the palm-side parts in which fingers indicated by a phantom line are inserted. Players who require the special specification do not insert their index finger in the index finger part 32 but insert their index finger in the middle finger part 33, their middle finger in the third finger part 34, and their two fingers, the third and little fingers, in the little finger part 35. This glove has an advantage that outfielders in particular can readily move their fingers in ball-catching motion. Such a special specification can be fulfilled by changing an angle of inclination of each joining line L1, L2, L3. In this case, in a similar way to the case of FIG. 4B, in the states of the plurality of the palm-side parts joined together, no change has been made to the overall size, i.e., the vertical length and the lateral length.

Figure 11:
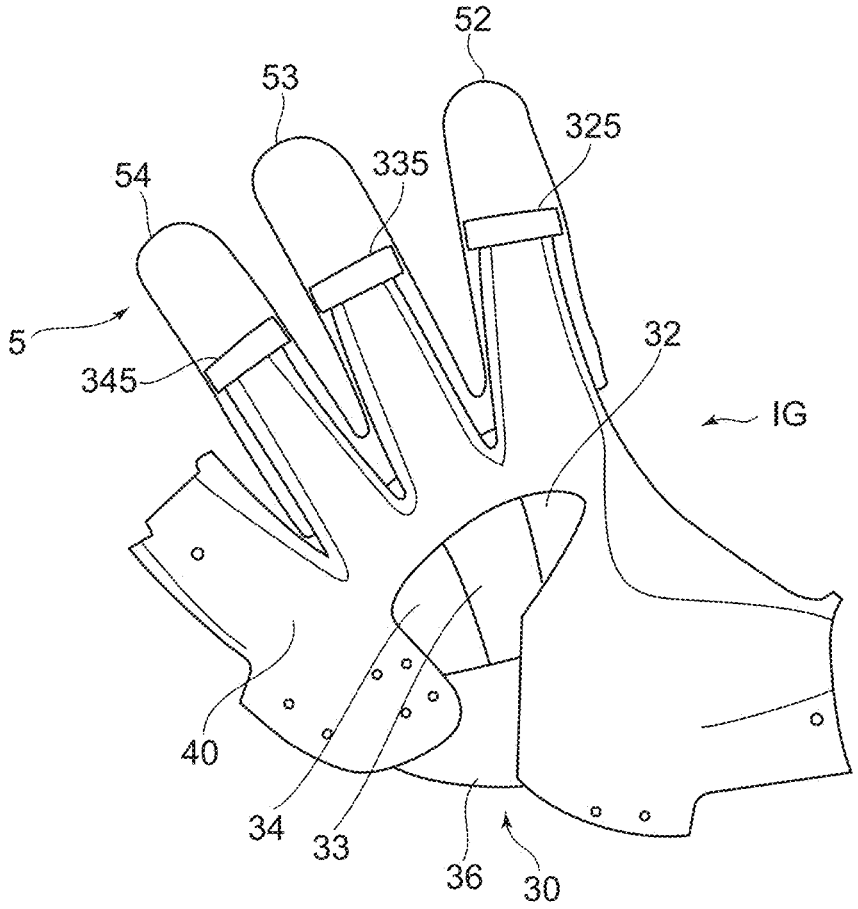
FIG. 11 is a drawing of a state of an inside glove unit joined by a cushioning material, viewed from the back side.
Figure 12:
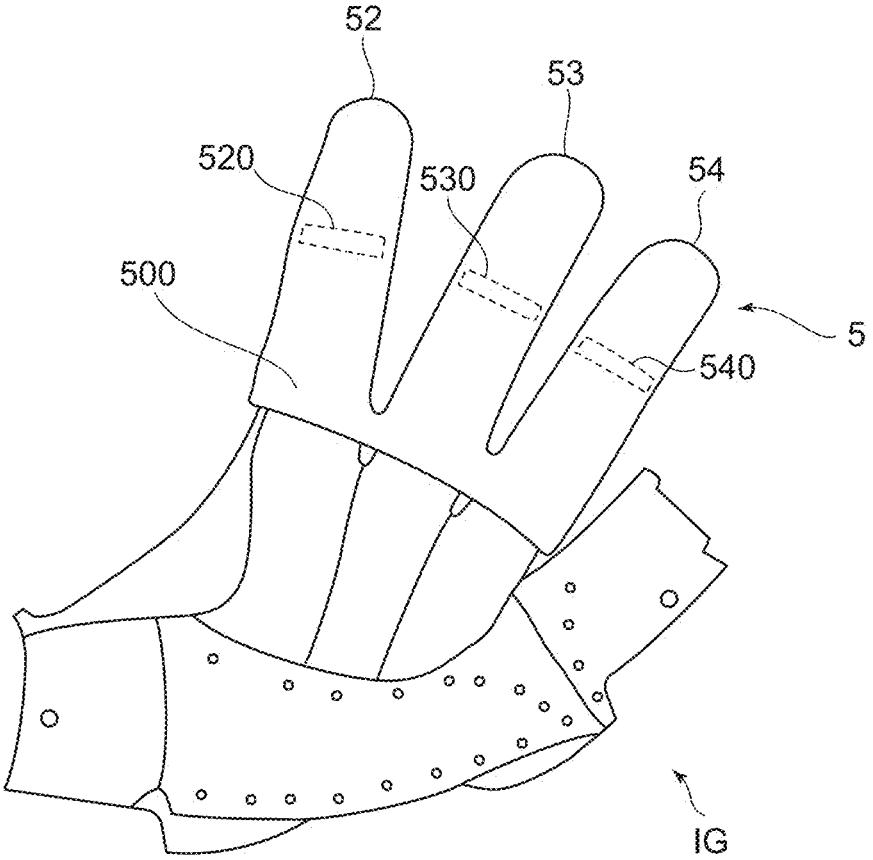
FIG. 12 is a drawing of a state of the inside glove unit joined by the cushioning material, viewed from the palm side.

FIGS. 11 and 12 each show a state of the inside glove unit IG equipped with a cushioning material 5. FIG. 11 is a drawing viewed from the back side, whereas FIG. 12 is a drawing viewed from the palm side. The cushioning material 5 includes an index finger section 52, a middle finger section 53, a third finger section 54, and a connecting section 500 that is disposed on a root side to integrate these sections together. The cushioning material 5 has a known configuration and serves to absorb shock at ball catching. In drawings other than the drawings above, illustration of the cushioning material 5 is omitted for convenience.

The cushioning material 5 is joined at the distal end 325 of the index finger part 32, the distal end 335 of the middle finger part 33, and the distal end 345 of the third finger part 34 by sewing 520, 530, 540.

Other Embodiments

Specific shapes of the parts that constitute the plurality of the palm-side parts 30 are not limited to the shapes in the present embodiment. Various modification examples can be applied.

In the present embodiment, the palm-side parts are a total of six parts including the five finger parts and the heel pad cover. However, the present disclosure should not be limited to this example. For instance, the palm-side parts may be a total of four parts including the index finger part, the middle finger part, and the third finger part that are independent of one another and the thumb part, the little finger part, and the heel pad cover that are integrated into one part.

The palm-side parts may be a total of five parts including the little finger part and the heel pad cover that are integrated into one part. The palm-side parts may be a total of five parts including the thumb part and the heel pad cover that are integrated into one part.

An area corresponding to the heel pad cover may have a plurality of divided parts rather than having one part.

DESCRIPTION OF REFERENCE SIGNS

| | |
|---|---|
| IG | inside glove unit |
| OG | outside glove unit |
| G | glove |
| L1, L2, L3, L4, L5, I6 | joining line |
| S, S10, S11, S12 | finger stall |
| 30 | a plurality of palm-side parts |
| 31 | thumb part |
| 32 | index finger part |
| 33 | middle finger part |
| 34 | third finger part |
| 35 | little finger part |
| 40 | back-side part |
| 5 | cushioning material |

What is claimed is:

1. A baseball glove including an outside glove unit and an inside glove unit that are combined together, the inside glove unit comprising:

one piece of a back-side part; and palm-side parts joined together to the back-side part, wherein the palm-side parts comprise at least an index finger part, a middle finger part, and a third finger part, wherein the index finger part, the middle finger part, and the third finger part are joined to the back-side part, and wherein a finger stall in which each of fingers is inserted is formed so as to have a flat shape on a back side and a curved shape suitable for a finger shape on a palm side.

2. The baseball glove according to claim 1, wherein the palm-side parts further comprise a thumb part and a little finger part.

3. The baseball glove according to claim 2, wherein the palm-side parts further comprise a sixth part that is joined to a root area of each of the index finger part, the middle finger part, the third finger part, the thumb part, and the little finger part.

4. The baseball glove according to claim 3, being designed to suit a small-sized palm through an adjustment intended to make root-side lengths of the index finger part, the middle finger part, and the third finger part longer and an adjustment intended to make a vertical width of the sixth part narrower with a vertical length and a lateral length of the inside glove unit remaining unchanged.

5. The baseball glove according to claim 3, being designed to form a shape of the finger stall that suits a finger size through an adjustment made to a width and a shape of each of the index finger part, the middle finger part, the third finger part, the thumb part, and the little finger part with a vertical length and a lateral length of the inside glove unit remaining unchanged.

6. The baseball glove according to claim 3, being designed to change a finger insertion site through an adjustment made to an angle of inclination of any of an inclined line of a place for joining the little finger part to the third finger part, an inclined line of a place for joining the third finger part to the middle finger part, and an inclined line of a place for joining the middle finger part to the index finger part with a vertical length and a lateral length of the inside glove unit remaining unchanged.

7. The baseball glove according to claim 3, wherein the sixth part and each of the index finger part, the middle finger part, the third finger part, the thumb part, and the little finger part are joined together by folding an end of the sixth part and an end of each of the index finger part, the middle finger part, the third finger part, the thumb part, and the little finger part at a place for joining to a ball catching surface side and sewing the folded ends together.

8. The baseball glove according to claim 3, wherein a portion of the middle finger part and a portion of the third finger part at a place for joining form an external shape such that the portions of the middle and third finger parts become increasingly separated from each other with an advance toward a finger root side, and a portion of the middle finger part and a portion of the index finger part at a place for joining form an external shape such that the portions of the middle and index finger parts become increasingly separated from each other with an advance toward the finger root side.

9. The baseball glove according to claim 2, wherein the back-side part comprises finger sections, wherein the finger sections comprise an index finger section, a middle finger section, a third finger section, a thumb section, and a little finger section corresponding to the index finger part, the middle finger part, the third finger part, the thumb part, and the little finger part, respectively, that constitute the palm-side parts, widths of the index finger part, the middle finger part, the third finger part, the thumb part, and the little finger part are set so as to be wider than respective widths of the corresponding finger sections, and the curved shape is formed when each of the finger sections of the back-side part is joined to each of the index finger part, the middle finger part, the third finger part, the thumb part, and the little finger part of the palm-side parts.

10. The baseball glove according to claim 9, wherein protrusions are formed at distal ends of the index finger part, the middle finger part, and the third finger part to protrude beyond respective distal ends of an index finger section, a middle finger section, and a third finger section of the back-side part when each of the finger sections of the back-side part is joined to the corresponding index finger part, the middle finger part, the third finger part, the thumb part, and the little finger part of the palm-side parts, and a cushioning material is joined to the protrusions.

11. The baseball glove according to claim 2, wherein two finger parts of the index finger part, the middle finger part, the third finger part, the thumb part, and the little finger part, which are adjacent to each other, are joined together by folding ends of the two finger parts at a place for joining to a ball catching surface side and sewing the folded ends together.

* * * * *